United States Patent [19]

Wallstén

[11] 4,076,864

[45] Feb. 28, 1978

[54] METHOD AND APPARATUS FOR COATING BOTH SIDES OF A MOVING WEB

[75] Inventor: Hans Ivar Wallstén, Lausanne, Switzerland

[73] Assignee: Inventing S.A., Lausanne, Switzerland

[21] Appl. No.: 717,187

[22] Filed: Aug. 24, 1976

[30] Foreign Application Priority Data

Aug. 26, 1975 Sweden ..... 7509461

[51] Int. Cl.[2] ..... B05D 3/12

[52] U.S. Cl. ..... 427/209; 118/404; 118/405; 118/407; 118/413; 427/211; 427/356; 427/361

[58] Field of Search ..... 118/404, 405, 407, 413; 427/209, 211, 356, 361

[56] References Cited

U.S. PATENT DOCUMENTS

| | | | |
|---|---|---|---|
| 3,070,066 | 12/1962 | Faeber | 118/413 |
| 3,484,279 | 12/1969 | Clark et al. | 427/356 |

*Primary Examiner*—Michael R. Lusignan
*Attorney, Agent, or Firm*—Louis Weinstein

[57] ABSTRACT

A method and apparatus for coating both faces of a moving web, such as a paper web, in which the web is fed longitudinally at a speed in excess of 300 meters per minute, between a rotating support roller and a blade, the blade having a bevel at the point of contact with the web. Coating material is fed into the nip between the roller and the web to coat the paper web on both faces. The angle which the blade forms with is chosen to be not greater than 20° and the bevel width, as measured in the direction of movement of the web, is at most 0.15 centimeters. Preferably the blade is urged against the web with a force not exceeding 0.20 kgf per centimeter width of web.

10 Claims, 8 Drawing Figures

METHOD AND APPARATUS FOR COATING BOTH SIDES OF A MOVING WEB

The present invention relates to a method and apparatus for coating both sides of a moving web, such as a paper web moving at a rate in excess of 300 m/min, whereby a coating agent is applied simultaneously to both sides of the web immediately prior to a nip for distribution and application of the coating agent — seen in the direction of movement of the web — and whereby the web is passed between two members forming the nip, one of which constitutes a movable support member such as a rotating roller, and the other constituting a blade bevelled to cooperate with the web.

The object of the present invention is to improve the coating technique described in Swedish Pat. No. 301,287 so that this technique can also be used for relatively high web speeds, i.e. web speeds in excess of 300 m/min.

Swedish Pat. No. 301,287 describes a method of simultaneously coating both sides of a paper-web — the so-called BILLBLADE method — in which the paper web is caused to pass a dam of coating compound when moving in the downward direction, said dam being limited if seen in the direction of movement of the web by a coating blade which presses said paper web against a rotating support member in the form of a roller so that the coating compound in the dam comes into contact with both sides of the paper.

When coating in accordance with this known method it has been found that certain factors relating to the blade and the force it exerts on the web is of decisive importance to the coating result, particularly if this method is to be used for relatively high web speeds. These factors must be adjusted both to the quality of the paper and to the speed of the paper web, viscosity of the coating material, etc.

According to the present invention there is now provided a method of coating both faces of a moving web, such as a paper web, comprising feeding the web longitudinally at a speed in excess of 300 meters per minute between a moving support member and a blade, the blade and the support member forming a nip, feeding coating material into the nip to produce a dam of coating material whereby the web is coated on both faces, controlling the angle of the blade so that it extends at an angle less than 20° relative to the web and choosing the bevel width, measured in the direction of movement of the web, to be at most 0.15 cm.

This invention also provides an apparatus for coating both faces of a moving web, such as a paper web, comprising means for moving the web at a speed in excess of 300 meters per minute, between a moving support and a blade forming with the moving support a nip, the blade having a bevel at the point of contact with the web and means for supplying coating material to the nip to coat both faces of the web, the bevel width, as measured in the direction of movement of the web being at most 0.15 cm.

The blade angle should preferably be less than 20° and the force of the blade against the web less than 2 kgf/cm width of web.

In order that the invention will be more fully understood, the following description is given merely by way of example, reference being made to the accompanying drawings, in which.

Figure 1:
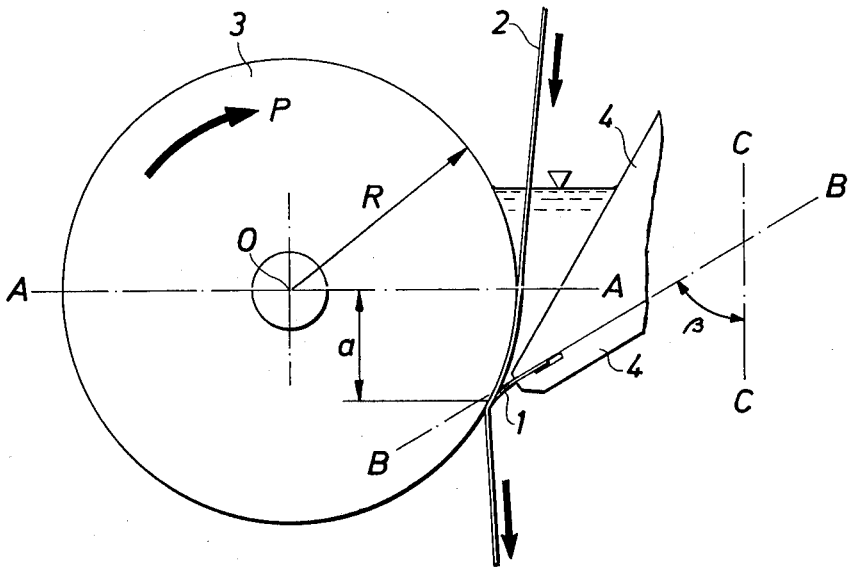
FIG. 1 is a schematic end view of a known device a so-called Billblade device.
Figure 2:
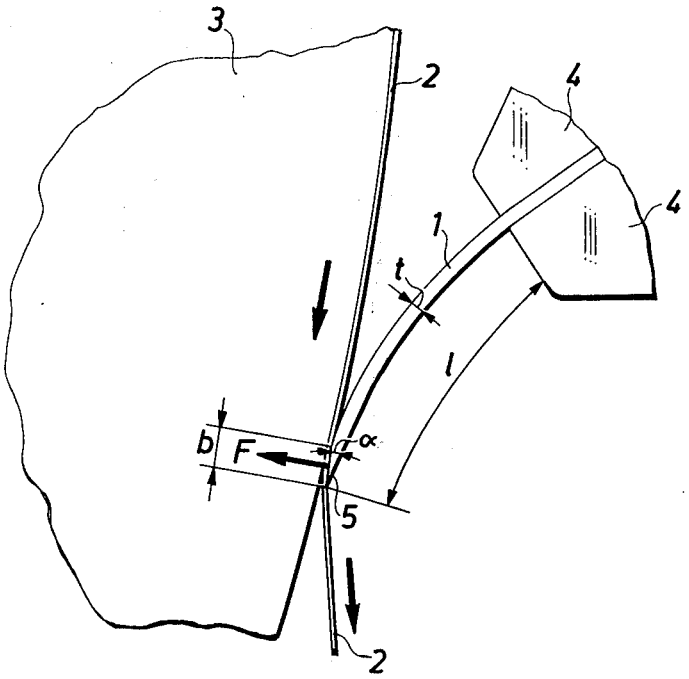
FIG. 2 is an enlarged portion of FIG. 1.

The known apparatus shown in FIGS. 1 and 2 operates principally in accordance with the technique described in Swedish Pat. No. 301,287 and comprises a blade 1, a paper web 2 and a supporting roller 3 rotating in the direction of the arrow P. The blade 1 is secured in a blade holder 4.

As can be seen in FIG. 1, the contact surface of the blade 1 with the paper web 2 or support roller 3 lies below the horizontal line A — A through the centre O of the roller 3. For various reasons it has been found advisable for the aforesaid point of contact to be below said horizontal line A — A but this is in itself not absolutely necessary for performance of the method. The angle between the centre line B — B of the blade holder and a vertical line C — C has been designated $\beta$. This is the so-called bladeholder angle.

FIG. 2 shows an enlargement of a portion of FIG. 1. The thickness of the blade 1 is designated *t*. As can be seen in both FIG. 1 and FIG. 2, the part of the coating blade 1 pressing against the paper web 2 has a bevel 5. This bevel 5 can either be effected by pregrinding the blade 1 or it may be formed by natural wear after some time in use. The bevel angle of the blade 1 has been designated $\alpha$. The width of the bevel on the blade 1, i.e. the distance of contact between the paper web 2 and the bevel 5 of the blade 1, measured in the longitudinal direction of the paper web, has been designated *b*.

Furthermore, in FIG. 1 the radius of the rotating support roller 3 has been designated R and the distance between the bevel 5 and the horizontal line A — A has been designated *a*. The length of the free portion of the blade 1, i.e. the portion of the blade protruding from the blade holder, which is called the clamping length of the blade, has been designated *l*.

As can be seen in FIGS. 1 and 2 the blade 1 is bent due to its flexibility and the angle $\alpha$ is therfore more acute than the angle $\beta$.

The following table indicates values which have been measured during commercial application according to this known BILLBLADE method. In all the examples the radius R = 300 mm and the distance *a* = approximately 100 mm.

Table 1

| Web speed m/min | Coating agent visc. cp | Coating agent dry content % | t mm | l mm | $\beta$ ° | $\alpha$ ° | b cm | F kgf/cm | $\frac{F}{b}$ kgf/cm² |
|---|---|---|---|---|---|---|---|---|---|
| 100 | 300 | 45 | 0,305 | 30 | 30° | 4° | 0,44 | 0,68 | 1,5 |
| 100 | 500 | 50 | 0,305 | 27 | " | 6° | 0.29 | 0.73 | 2,5 |
| 200 | 500 | 60 | 0,381 | 30 | " | 5° | 0,44 | 1,36 | 3,1 |
| 200 | 1000 | 55 | 0,381 | 27 | " | 8° | 0,27 | 1,5 | 5,0 |

Table 1-continued

| Web speed m/min | Coating agent visc. cp | Coating agent dry content % | t mm | l mm | β ° | α ° | b cm | F kgf/cm | $\frac{F}{b}$ kgf/cm² |
|---|---|---|---|---|---|---|---|---|---|
| 300 | 500 | 50 | 0,457 | 30 | " | 6,5° | 0.33 | 2,05 | 5,5 |
| 300 | 1000 | 55 | 0,457 | 27 | " | 9,0° | 0,29 | 2,3 | 7,9 |
| 400 | 500 | 50 | 0,508 | 30 | " | 6,5° | 0,45 | 2,6 | 5,8 |
| 400 | 1000 | 55 | 0,508 | 27 | " | 9,0° | 0.32 | 3,17 | 9,8 |
| 500 | 500 | 50 | 0,508 | 27 | " | 9,0° | 0,32 | 3,17 | 9,8 |
| 200 | 2000 | 60 | 0,508 | 27 | " | 10,0° | 0,32 | 3,17 | 9,8 |

In all blade coating processes the blade is pressed against the paper web both to wipe off the excess and also to spread the coating layer uniformly with the help of a springy blade. This also applies to coating according to the known BILLBLADE method. In view of the hydraulic forces caused by the fairly vigorous movement of the coating compound during the coating process a force is exerted on the coating blade which counteracts the spring force of the blade itself when it is pressed against the paper web. In the BILLBLADE process, as in other blade-coating processes, therefore, the spring force must be increased at higher web speeds and/or higher viscosities of the coating compound in order to compensate for the increased hydraulic pressure on the blade so that the desired quantity of compound is applied on the paper. According to the BILLBLADE method this is solved by using thicker blades and/or shorter clamping length for the blade. This is also clear from the table shown above.

From the same table it can be seen that the blade angle α in the examples selected of the BILLBLADE method is between 4° - 10°. The reason for this is inter alia that the acute angle gives an advantageous wedge effect so that particles, impurities or irregularities pass more easily under the blade.

However, it has been found that there is an upper limit in practice for the spring force at high web speeds when coating in according with the BILLBLADE method. This is because the risk of a web rupture increases if a thick blade is used, possibly in combination with a shorter clamping distance, especially if the paper is thin or weak.

This is primarily because the spring force of the blade, i.e. the total force of the blade perpendicular to the contact surface of the bevel is too great. This force, i.e. the spring force, has been designated F in FIG. 2. Particularly when starting, i.e. when the blade 1 is pressed against the paper web 2 and the coating compound has perhaps not yet completely filled the space intended therefor, the paper is subjected to considerable stress since the hydraulic pressure mentioned has not yet fully developed and therefore does not completely balance the spring force of the blade. If the spring force is too great in relation to the strength of the paper at the moment of starting, the high stresses may cause rupture of the web.

Furthermore, a relatively thick blade with relatively short clamping length has poor flexibility. By "flexibility" is meant the so-called spring constant or spring ratio defined as the ratio between a load alteration at the free end of the blade and the alteration in position caused thereby. A certain flexibility is desirable in blade coating processes because of sudden variations which may be caused by defects in the paper web in the form of lumps of compound, irregularities, folds, etc. Good flexibility in the coating blade also contributes to eliminating variations in the blade-holder members across the paper web. As is known, the spring ratio is dependent on the elastic modulus of the material, clamping length and clamping method (for instance, jointed support and permanent clamping or only permanent clamping) and the thickness of the blade.

After comprehensive investigation it has been found that the coating quantity is extremely dependent on the so-called specific pressure (surface pressure) when coating under otherwise identical conditions. On the other hand the quantity of coating compound applied is less dependent on the spring force at the same surface pressure. The specific pressure is defined as the quotient of the spring force and the width per width unit blade of the blade bevel 5 (F/*b*) per width unit blade).

With the help of a special simulator it has been possible to measure the values of F and (F/*b*) given in Table 1.

As can be seen from Table 1 relatively thick coating blades (0.5 mm or more) must be used with high speeds and/or high viscosities in order to achieve satisfactory coating. However, as has been mentioned, it has been found that this results in an abnormally high frequency of web rupture, primarily because the spring force becomes too high (i.e. it exceeds 2 kgf/cm) and also because the blade is too inflexible particularly if the clamping length is short (27 mm or less).

It might therefore be assumed that this situation would be considerably improved if relatively thin blades with a shorter clamping length were used. However, such a solution is not feasible with this known BILLBLADE technique. The reason for this is that the coating compound in this known method is supplied to the dam on both sides of the paper web. It is supplied in copious excess through a suitable supply system and so that the supply is distributed across the entire width of the web. The excess coating compound flows out at the two ends of the dam and is collected to be returned to the system for re-circulation. Since the excess compound is often 10 to 15 times greater than the quantity applied, vast quantities of excess compound run out at the sides with high web speeds. Since normally more water is absorbed from the coating compound during coating than dry substance, the excess compound will become thicker. It is therefore important that the supply of fresh compound from above is distributed as evenly as possible across the paper web so that as far as possible a constant dryness content is maintained in the flow of excess compound. If not, there is a risk of uneven coating across the paper web. This is one of the reasons for having vast quantities of excess compound. For obvious reasons the excess quantities are also dependent on the web speed; larger quantities of excess compound are therefore used for higher web speeds.

Figure 3:
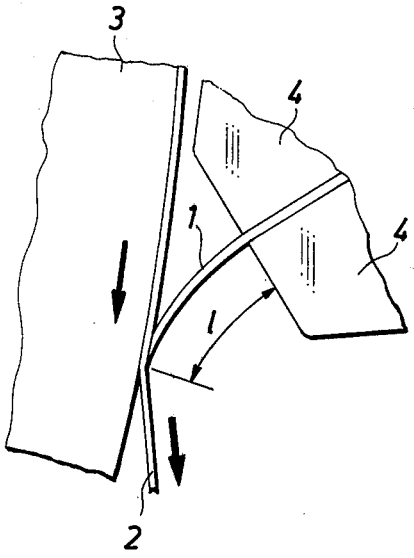
FIG. 3 is a view similar to FIG. 2, showing a modified arrangement.

FIG. 3 shows in principle the same components as FIG. 2 with a short clamping length. It is also clear from FIG. 3 that if the free clamping length $l$ is made short, the lower part 4 of the blade holder will be very close to the paper web 2 and the dam space limited by the roller surface 3, blade 1 and lower part of the blade holder 4 will be extremely small. Due to the cramped space the flow of excess compound is throttled, resulting in the compound becoming thicker in an uncontrolled manner and this has led to varying dryness contents across the paper web with an unacceptable coating result as a consequence. In some cases the dryness content may rise so sharply in patches that a rupture occurs in the web.

In conclusion, therefore, experts have until now sought to solve the present problem by increasing the spring force, i.e. by using a thicker blade and/or shorter clamping length. However, such solutions cannot be satisfactory since a thicker blade gives poorer flexibility with increased risk of web rupture and a short clamping length encroaches noticeably on the necessary dam space. Furthermore, there is also a practical limit to such solutions since a high contact pressure of the blade, i.e. considerable spring force, resulting in an immediate web rupture especially when starting up the device and particularly if thin paper webs are being run.

Various embodiments according to the present invention are shown in FIGS. 4, 5, 6 and 7, in which these problems are overcome.

Figure 4:
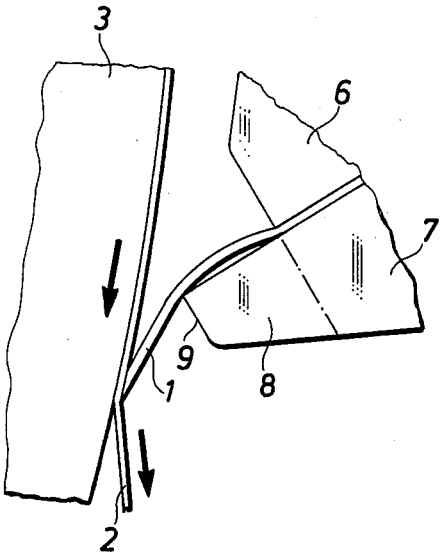
FIGS. 4 to 8 are further views similar to FIG. 2, showing portions of various embodiments of apparatus according to the invention.

In the embodiment according to FIG. 4 a relatively thin blade 1 is used with a relatively long clamping length. The blade 1 is secured in the blade holder between an upper clamping jaw 6 and a lower clamping jaw 7. The lower clamping jaw 7 has a protruding front portion 8, the front edge of which is designated 9. When pressed against the paper web 2 and support roller 3 the blade 1 is bent in such a way that it abuts the edge 9, this edge forming a so-called jointed support for the blade. The blade 1 is clamped at its upper end between the clamping jaws 6 and 7.

The embodiment shown in FIG. 4 enables the use of relatively thin blades 1 even when coating with high web speeds and/or high viscosities in the coating compound. This is because the blade 1 is relatively thin so that a comparatively high specific pressure can be obtained without too much spring force. Two advantages are thus gained, as should also be clear from the above. The high specific pressure enables a limitation of the quantity applied at high web speeds since this quantity is to a considerable extent dependent on the specific pressure. On the other hand, the relatively thin blade has comparatively low spring force and good flexibility. This therefore eliminates the risk of web rupture in the event of defects in the paper web or when using thin or weak qualities of paper. At the same time, the advantage has been gained that the space for the coating compound dam may still be sufficiently large, i.e. the distance in horizontal direction between the front edge of the clamping jaw 6 and the paper web 2 and the distance from the paper web 2 and roller surface 3 can be kept sufficiently large.

Figure 5:
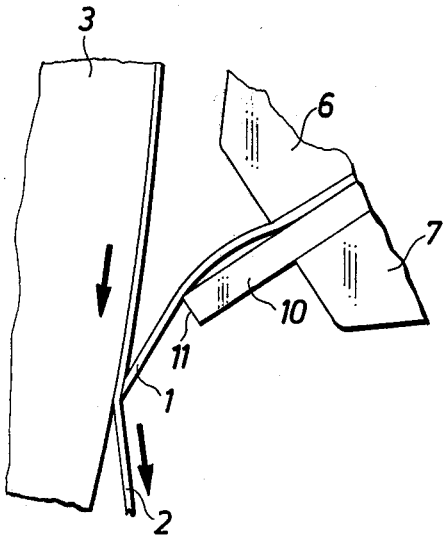

FIG. 5 shows another embodiment of the invention. The blade holder in this case consists of an upper clamping jaw 6 and a lower clamping jaw 7. Between these jaws the comparatively thin blade is clamped. Below the blade 1 and between the jaws 6 and 7 is a support blade 10. This support blade which is arranged between the jaws but below the blade 1 has a forward protruding section, the front edge of which is designated 11. This arrangement serves the same purpose as the means according to FIG. 5, but the removable support blade 10 thus replaces the protruding section 8 of the lower clamping jaw 7 in function.

Figure 6:
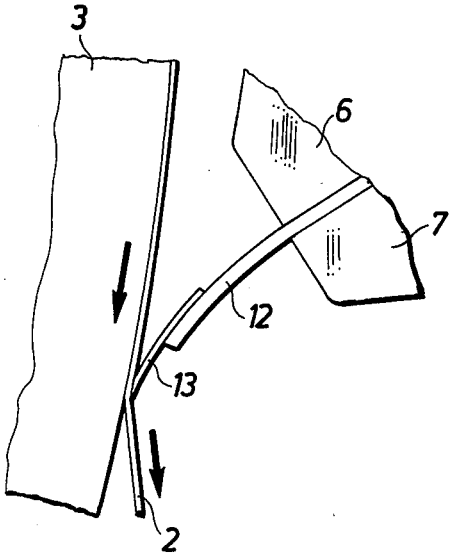

FIG. 6 shows another embodiment according to the invention. In this case the blade holder consists of two clamping jaws 6 and 7 between which a blade 1 is secured. The clamped blade consists of two parts 12 and 13. Part 12 is relatively thick and rigid and may preferably consist of a separate blade. Part 13 is relatively thin and more flexible and may consist of a separate blade which is jointed in some suitable manner, such as welding or gluing, to the blade 12. This embodiment also gives the advantage of a high specific pressure since the blade 13 is very thin and flexible. At the same time, since the thin blade 13 is attached in the thicker, firmly clamped blade 12, sufficient space is obtained for the dam in which the coating compound flows.

Figure 7:
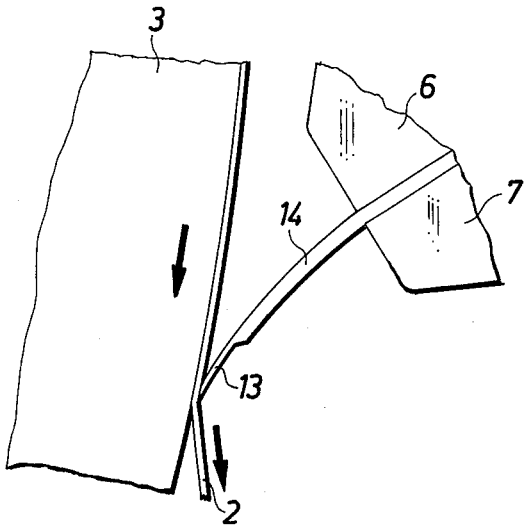

FIG. 7 shows another embodiment within the scope of the invention. Here, a single blade made out of a homogenous blank is clamped between two clamping jaws 6 and 7.

The edge section 13 of the blade is relatively thin and the section 14 towards the clamped part is thicker than the section 13. The advantages mentioned above when coating with high speeds and/or high dryness contents and thin or weak qualities of paper are therefore also obtained in this case. In the embodiment according to FIG. 7 the blade may preferably be manufactured from a blade having thickness desired for the part 14 and the thinner section 13 be obtained by grinding away material.

All the embodiments according to the invention described above, i.e. corresponding to FIGS. 4 through 7 have been tested with extremely good results. It has been possible by means of special simulators to measure the spring force F and bevel width $b$ in the various applications. From these values it has been possible to calculate the specific pressure $F/b$.

It has thus proved possible to keep the spring force below 2 kgf/cm even when coating at extremely high speeds using coating compound having relatively high dryness contents and viscosities since the specific pressure can be kept high at the same time. Because the blade is also extremely flexible it has also been possible to coat thin, relatively weak (for instance unsized) paper and still maintain a high degree of reliability in operation and low rupture rate. The quality of the coated paper was extremely high. Even with extremely high speeds (about 1100 m/min) the formation of mist could be avoided, which otherwise easily occurs at extremely high speeds due to small drops of coating compound being formed between roller and paper web at the moment when the paper web leaves the roller (so-called film-split effect).

The following Tables 2 and 3 give some examples of measured and calculated values upon application of the invention in the various embodiments described above (corresponding to FIGS. 4, 5, 6 and 7). Steel blades have been used in all cases. Several different qualities of paper were tested. For instance, a completely unsized newspaper having a mass per unit area of 38 g/m$^2$ was coated at high speed. Such paper is relatively weak and can hardly be coated at high speeds in the traditional manner without the risk of the web constantly breaking. However, it has been found that even such weak qualities of paper can perfectly well be coated according to the BILLBLADE method by making use of the invention while retaining a high degree of reliability.

Table 2

| Embodiment according to Figure | | 4 | 4 | 5 |
|---|---|---|---|---|
| Free blade length | mm | 10 | 10 | 5 |
| length of support lip | mm | 17 | 17 | 22 |
| blade thickness | mm | 0,31 | 0,25 | 0,15 |
| spring force | F kgf/cm | 1,93 | 1,33 | 0,40 |
| bevel width | b cm | 0,118 | 0,098 | 0,058 |
| F3b | kgf/cm$^2$ | 16,3 | 13,5 | 24 |
| edge angle | ° | 15 | 16 | 17 |
| quantity applied | g/m$^2$ and side | 10 | 10 | 10 |
| speed | m/min | 900 | 700 | 800 |
| dryness content of compound | % | 53 | 53 | 58 |
| viscosity of compound | centipois | 600 | 600 | 1500 |

TABLE 3

| Embodiment according to Figure | | 6 | 7 | 7 |
|---|---|---|---|---|
| blade length thin section | mm | 10 | 8 | 6 |
| blade length thick section | mm | 20 | 22 | 24 |
| blade thickness thin section | mm | 0.15 | 0.10 | 0.07 |
| blade thickness thick section | mm | 0.45 | 0.45 | 0.45 |
| spring force | F kgf/cm | 1.0 | 1.0 | 1.0 |
| bevel width | b cm | 0.08 | 0.045 | 0.031 |
| F/b | kgf/cm$^2$ | 12.8 | 22 | 32 |
| edge angle | ° | 13 | 14 | 15 |
| quantity applied | g/m$^2$ and side | 10 | 12 | 13 |
| speed of web | m/min | 500 | 600 | 900 |
| dryness content of compound | % | 53 | 58 | 62 |
| viscosity of compound | centipois | 600 | 1500 | 1700 |

Thus according to the invention thin blades could also be used with high web speeds and/or highly viscous coating compounds and the blade and blade holder can be adjusted to allow a blunter blade edge angle to be used than is possible in conventional arrangements (for instance in accordance with Table 1). Due to the reduced spring force irregularities can pass more easily under the blade, i.e. it is unnecessary to aim at an extremely good wedge effect, using very acute blade angles. It is thus clear from the examples in Tables 2 and 3 that the blade edge angles are between 13° and 17°. It should, however, be pointed out that good results are also achieved with angles of less than 13°. Somewhat blunter angles, for instance between 13° and 20°, have other advantages on the other hand, as will be shown in the following.

It has also been found that the invention enables simple regulation of the quantity applied during the coating process. This is achieved by turning the blade holder in the various embodiments so that the angle $\beta$ is altered.

By increasing the angle $\beta$, for instance, the specific pressure will also be increased, which results in less coating compound being applied. However, if a traditional blade holder 4 in accordance with FIG. 3 were to be used for coating with high web speeds, an increase in the blade holder angle would cause the horizontal distance between roller and blade/blade holder to decrease even further, giving the drawbacks previously pointed out. With the embodiments according to FIGS. 4, 5, 6 and 7 proposed according to the invention the blade holder can be turned without the space for the dam becoming critical.

Regulation of the application quantity by turning the blade holder has great advantages over arrangements already known for this purpose which operate with a variation in blade pressure. In conventional blade coating, for instance, inflatable tubes or mechanical means are often used to influence the blade at a point between the attachment point of the blade in the holder and the free end of the blade. In the embodiments shown in FIGS. 4 and 5 the length of the protruding part 8 and 10, respectively, is adjusted in advance taking into account the desired degree of influence with respect to the coating quantity by turning of the blade holder. In the embodiments shown in FIGS. 6 and 7 the length of the thin section 13 is similarly adjusted in advance in relation to the thick section 12 and 14, respectively, taking into account the adjustability desired by turning the blade holder.

Conventional means may be used to turn the blade holder for adjustment of the application quantity during the coating process. If, for instance, the blade holder is pivotably journalled about a shaft it can be extremely accurately turned by a suitable mechanical system. In this connection it should be pointed out that often only a slight alteration of the blade holder angle $\beta$ is necessary in order to achieve the desired result.

It may also be mentioned that in order to obtain a satisfactory result when regulating the coating quantity by altering the angle $\beta$ the blade edge angle $\alpha$ should not be too small. If the angle is very small (less than 10° for instance) an increase in the blade holder angle aimed at achieving higher specific pressure will have very little effect since when the angle $\beta$ is increased the blade edge angle $\alpha$ will at the same time decrease due to the curve of the blade, which increases the bevel width $b$. Thus, particularly with small blade edge angles, the intended increase in specific pressure is counteracted since the contact surface between blade bevel and paper web increases.

However, it has been found that extremely satisfactory regulation can be achieved if the factors affecting the coating are selected so that the blade edge angle is preferably between 20° - 15°.

Figure 8:
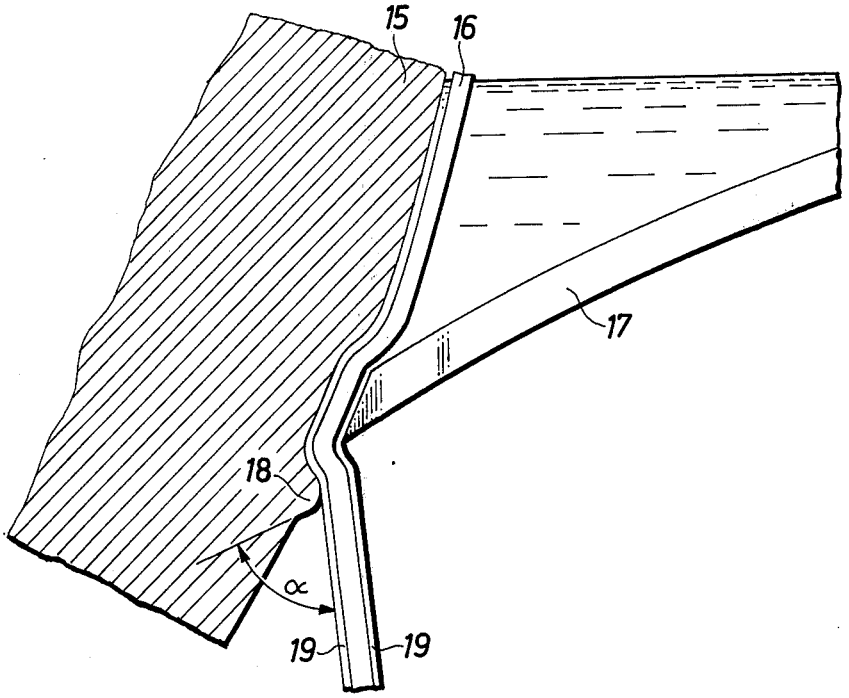

Surprisingly it has been found that paper coated in accordance with the invention has been coated equally well on both sides when coating with compounds having a high dryness content. Previously, when producing coated newspaper in accordance with the method described in Swedish Pat. No. 301,287, for instance, using relatively high dryness contents and/or viscosities for the coating compound with perhaps a dryness content of over 53% and/or a viscosity of over 600 cp in order to achieve a relatively great quantity applied, it has sometimes been observed that there is a certain difference in the two sides of the paper both with respect to the uniformity of the coating thickness and to its distribution. This problem is particularly noticeable on the side of the paper web facing the roller during the coating process. When being coated with compound having relatively high viscosity and/or dryness contents, this side shows a tendency to greater absorption of the coating compound than the opposite side of the paper web as well as a certain tendency towards irregularities in the coating layer. Surprisingly, it has now proved possible to eliminate or considerably reduce this tendency in cases when the dryness content of the coating compound exceeds 53%. This is especially so if the surface of the support roller is covered with a resilient material such as rubber which has a hardness preferably not less than 70 P & J and under no circumstances less than 55 P & J. Another condition is that the specific pressure is sufficiently high, i.e. preferably exceeds 12 kgf/cm$^2$ and is under no circumstances less than 10 kgf/cm$^2$. This surprising effect is probably due to the fact that the rubber sleeve on the support roller is depressed to a certain extent when using the small bevel widths and sufficiently high specific pressure defined within the scope of the invention, which is necessary in accordance with the above when coating with coating compounds having high dryness contents. This is especially so if the sleeve is sufficiently resilient. Due to this depression and the resilience of the roller material, therefore, the rubber material will bulge out along a line following the pointed edge of the blade. The radius of this bulge is small, perhaps a few millimeters. This is shown in more detail in FIG. 8 where the surface covering of the soft rubber roller is designated 15, the paper web 16, the blade edge 17, the bulge running along the blade edge 18 and the angle formed between the paper web and the bulge, i.e. the so-called deduction angle $\gamma$ (gamma). Presumably due to the known so-called film-split effect, the relatively large deduction angle $\gamma$ contributes to a uniform surface being obtained also on the roller side when coating with high dryness contents and high specific pressure within the scope of the invention. In this connection it should also be pointed out that obviously the speed of the roller surface at the point where the paper web leaves it is different from its speed during earlier contact with the paper web and in relation to the surface of the paper web, which may also explain the effect obtained.

I claim:

1. A method of coating both faces of a moving web, such as a paper web, comprising feeding the web longitudinally at a speed in excess of 300 meters per minute between a moving support member and a blade, the blade and the support member forming a nip, feeding coating material into the nip to produce a dam of coating material whereby the web is coated on both faces, controlling the angle of the blade so that it extends at an angle less than 20° to the web and choosing the bevel width, measured in the direction of movement to the web, to be at most 0.15 cm, said blade being urged against the web with a force not exceeding 2 kgf per cm width of web.

2. In an apparatus for coating both faces of a moving web, such as a paper web, moving at a speed in excess of 300 meters per minute, in which the web is fed between a moving support and a blade forming with the moving support a nip, the blade being thin and flexible and having a bevel at the point of contact with the web, in which coating material is supplied to the nip to coat both faces of the web, the improvement consisting in that the bevel width, as measured in the direction of movement of the web, is at most 0.15 cm.

3. In an apparatus as claimed in claim 2, the improvement consisting in that the blade edge angle between the blade edge and the web is less than 20°.

4. In an apparatus as claimed in claim 2, the improvement consisting in that the apparatus further comprises means for pressing the blades into contact with the web with a spring force less than 2 kgf per cm width of web.

5. In an apparatus as claimed in claim 2, wherein the movable support member comprises a rotating roller, the improvement consisting in that the roller has a resilient covering having a hardness of at least 55 P and J, in that the bevel width of the blade measured in the direction of movement of the web does not exceed 0.08 mm and in that the blade is arranged to be pressed with a spring force not exceeding 2 kgf per cm width of web.

6. The apparatus of claim 2 wherein said blade is formed of a first thick blade member; a support for holding one end of said thick blade member; a thin blade member secured to the free end of the thick blade member remote from said holder and having a thickness which is significantly less than the thickness of said thick blade member.

7. The apparatus of claim 2 wherein the thickness of said thin blade member is preferably between 0.1 and 0.15 mm.

8. The apparatus of claim 2 wherein said blade comprises a thick blade member; a holder for holding one end of said thick blade member; the free end of said thick blade member being machined so as to provide a portion of reduced thickness wherein said portion of reduced thickness is less than half the thickness of the remaining portion of said thick blade member.

9. The apparatus of claim 2 comprising a blade holder provided with first and second holding members for clamping one end of said blade therebetween; one of said holding members having an end extending beyond one end of the remaining one of said holding members and in the direction of the free end of said blade so as to bear against the portion of said blade located beyond the clamped portion of the blade to increase the biasing force imparted upon the blade by the holder.

10. The apparatus of claim 2 further comprising means positioned intermediate the clamped end of the blade and the free end of the blade for imparting an additional biasing force upon the blade.

* * * * *

UNITED STATES PATENT AND TRADEMARK OFFICE

CERTIFICATE OF CORRECTION

PATENT NO. : 4,076,864

DATED : Feb. 28, 1978

INVENTOR(S) : Hans Ivar Wallsten

It is certified that error appears in the above-identified patent and that said Letters Patent are hereby corrected as shown below:

In the ABSTRACT, line 8 should read --The angle which the blade forms with the web is chosen to be--.

Column 1, before line 5, insert --BACKGROUND OF THE INVENTION--.

Column 1, after line 38 and before line 39, insert --BRIEF DESCRIPTION OF THE INVENTION--.

Column 2, after line 5 and before line 6, insert --BRIEF DESCRIPTION OF THE FIGURES--.

Column 2, after line 17 and before line 18, insert --DETAILED DESCRIPTION OF THE INVENTION AND ALTERNATIVE EMBODIMENTS THEREOF--.

Column 3, line 27, after "paper" insert --web--.

Column 6, line 49, before "speeds" insert --linear web--.

UNITED STATES PATENT AND TRADEMARK OFFICE

CERTIFICATE OF CORRECTION

PATENT NO. : 4,076,864

DATED : Feb. 28, 1978

INVENTOR(S) : Hans Ivar Wallsten

It is certified that error appears in the above-identified patent and that said Letters Patent are hereby corrected as shown below:

Column 7, in Table 2, seventh line down from the top thereof, "F3b" should read --F/b--.

Column 7, in Table 3, fourth line up from the bottom, "and side" should read --on each side--.

Column 7, in Table 3, bottom line, "centipois" should read --centipoise--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*